US009840362B2

(12) United States Patent
Park

(10) Patent No.: US 9,840,362 B2
(45) Date of Patent: Dec. 12, 2017

(54) CAP FOR GAS VESSEL HAVING SEPARABLE GAS EXHAUST UNIT

(71) Applicant: DAE RYUK CAN CO., LTD., Seoul (KR)

(72) Inventor: Bong June Park, Seoul (KR)

(73) Assignee: Dae Ryuk Can Co., Ltd., Seoul (KR)

( * ) Notice: Subject to any disclaimer, the term of this patent is extended or adjusted under 35 U.S.C. 154(b) by 143 days.

(21) Appl. No.: 14/959,415

(22) Filed: Dec. 4, 2015

(65) Prior Publication Data

US 2017/0029200 A1 Feb. 2, 2017

(30) Foreign Application Priority Data

Jul. 31, 2015 (KR) ..... 20-2015-0005159 U
Sep. 2, 2015 (KR) ..... 20-2015-0005870 U
Sep. 11, 2015 (KR) ..... 10-2015-0129258

(51) Int. Cl.
*B65D 83/00* (2006.01)
*B65D 83/20* (2006.01)

(52) U.S. Cl.
CPC ..... *B65D 83/205* (2013.01)

(58) Field of Classification Search
CPC ..... B65D 83/205; B65D 83/24
USPC ..... 222/402.14; 141/20, 3
See application file for complete search history.

(56) References Cited

U.S. PATENT DOCUMENTS 3,920,162 A * 11/1975 Kimura ..... B65D 83/40 222/182
4,195,756 A * 4/1980 Campbell ..... B65D 83/20 220/256.1
4,426,025 A * 1/1984 Knickerbocker ..... B65D 83/24 222/182
6,021,927 A * 2/2000 Nomiyama ..... B65D 83/24 222/182
6,053,373 A * 4/2000 Sutton ..... B05B 12/002 141/20
6,382,473 B1 * 5/2002 Mekata ..... B65D 83/205 222/402.14

FOREIGN PATENT DOCUMENTS

JP 2004075124 A 3/2004
JP 2007331800 A 12/2007
KR 101427255 B1 7/2014

* cited by examiner

*Primary Examiner* — Jeremy W Carroll
(74) *Attorney, Agent, or Firm* — McKee, Voorhees & Sease, PLC

(57) ABSTRACT

The present invention relates generally to a cap for a gas vessel that has a separable gas exhaust unit. The gas exhaust unit may be integrally formed in the upper surface of the vessel cap so as to be separably attached by ribs. The gas exhaust unit may also be formed to be coupled to a mounting cup while pressing a valve stem of the gas vessel. The cap for a gas vessel having a separable gas exhaust unit may also include one or more gas injection adaptors integrally formed in the edge of the vessel cap so as to be separated by ribs. According to the present invention, the gas exhaust unit can be separated from the cap or a mounting cup of the vessel for its use when necessary.

14 Claims, 8 Drawing Sheets

CAP FOR GAS VESSEL HAVING SEPARABLE GAS EXHAUST UNIT

CROSS-REFERENCE TO RELATED APPLICATIONS

This application claims priority under the Paris Convention (35 U.S.C. §119) to Korean Application No. 20-2015-0005159 filed Jul. 31, 2015, and Korean Application No. 20-2015-0005870 filed Sep. 2, 2015, and Korean Application No. 10-2015-0129258 filed Sep. 11, 2015, the contents of all are herein incorporated by reference in their entirety.

FIELD OF THE INVENTION

The present invention generally relates to a cap for a gas vessel that has a separable gas exhaust unit. More specifically, but not exclusively, the present invention relates to a cap for a gas vessel that has a separable gas exhaust unit integrally formed with the vessel cap, wherein the gas exhaust unit is separated from the vessel cap when being used and is coupled to a mounting cup of a gas vessel, in which gas is received, to press a valve stem, thereby exhausting residual gas or continuously exhausting gas.

BACKGROUND OF THE INVENTION

In general, an aerosol can refers to a vessel for spraying contents to the outside by using spray gas in a state in which the contents (fluid or gas) to spray and the spray gas (propellant or propelling gas) are received in the vessel.

Examples of the spray gas may include compressed gas, such as carbon dioxide, nitrous oxide, compressed air, and liquefied gas such as butane gas, propane gas, dimethyl ether (DME), etc., and representative examples of the aerosol can may include mosquito repellant spray, hair spray, and the like.

Further, cigarette lighter gas (fuel) is also used while being received in a can container.

Meanwhile, aerosol cans, such as mosquito repellent spray, hair spray, and the like, or cigarette lighter gas cans are discarded after the contents thereof are completely used. In this case, safety accidents, such as residual gas explosion due to high temperature heat transferred from the outside, frequently happen.

In order to prevent the safety accidents, it is recommended that empty aerosol cans or cigarette lighter gas cans, the contents of which are completely used, be discarded after the residual gas is exhausted through holes formed therethrough.

However, it is very difficult to expect this practice from general consumers because it is very cumbersome to bore a hole through an aerosol can with a sharp or keen tool in order to exhaust spray gas from the aerosol can every time the aerosol can is completely used.

In order to solve the problem, Korean Utility Model No. 20-0454617 (Published on Jul. 15, 2011) discloses a vessel cap that has a residual gas exhaust structure. The vessel cap that has the residual gas exhaust structure includes: a cap member that is formed to protect a nozzle assembly provided on a vessel and has a vertically extending support wall in an opening formed in the upper portion thereof; and a push member that is connected to the opening of the cap member through the support wall and a connecting piece to vertically rotate downward, and presses a valve stem of the nozzle assembly when being pressed by a user.

According to the vessel cap that has the residual gas exhaust structure, residual gas that remains after a gas vessel is completely used can be forcibly exhausted and removed by a simple operation of the vessel cap, thereby solving inconvenience and danger that may happen when residual gas is removed using a separate tool in the related art. In addition, the gas vessel can be safely discarded by removing the residual gas using the vessel cap in an easy and simple manner, thereby preventing safety accidents, such as fire and burning, which may happen when a discarded vessel with residual gas is treated.

However, since the push member for pressing the valve stem of the nozzle assembly is integrally formed with the vessel cap in the residual gas exhaust structure according to the related art, a safety accident may happen due to unintended gas exhaust in cases where the push member is pressed out of curiosity or by mistake in a situation in which the push member should not be pressed, that is, in a state in which the vessel cap is coupled to a vessel.

BRIEF SUMMARY OF THE INVENTION

Therefore, it is a primary object, feature, and/or advantage of the invention to improve on and/or overcome the deficiencies in the art.

An aspect of the present invention is to provide a means for allowing a gas exhaust unit, which is employed for an aerosol vessel, a cigarette lighter gas vessel, or another gas vessel to easily exhaust residual gas therein, to be separated from a vessel cap only when necessary, thereby preventing a safety accident caused by unintended gas exhaust which results from operating the gas exhaust unit out of curiosity or by mistake.

Another aspect of the present invention is to provide a means capable of easily separating a gas exhaust unit coupled to a mounting cup.

Aspects of the present invention are not limited to the aforementioned ones, and other unmentioned aspects of the present invention will be clearly understood from the following description by those skilled in the art to which the present invention pertains.

In accordance with an aspect of the present invention, a cap for a gas vessel having a separable gas exhaust unit, which includes one or more gas injection adaptors integrally provided so as to be separable and is coupled to a seaming part of the gas vessel to cover the upper portion of the gas vessel, includes a gas exhaust unit that is formed to be coupled to a mounting cup while pressing a valve stem of the gas vessel. The exhaust unit may be integrally formed in a storage hole, which is formed on the upper surface of the vessel cap, through ribs so as to be separable, and is separated from the vessel cap by breaking the ribs when the gas exhaust unit is used, wherein the gas exhaust unit includes: a pressing part formed in the central portion of an insertion part, which protrudes toward the bottom of the mounting cup, to press the valve stem inserted thereinto; extension ends bilaterally extending from the edge of the insertion part so as to be symmetric to each other; and coupling ends that are vertically formed on the extension ends, respectively, and are stopped by and coupled to the mounting cup to make the pressing part press the valve stem.

In accordance with another aspect of the present invention, a cap for a gas vessel having a separable gas exhaust unit, which is coupled to a seaming part of the gas vessel to cover the upper portion of the gas vessel and may or may not include one or more gas injection adaptors, which are separately manufactured and are provided so as to be separable. The gas exhaust unit may be formed to be coupled to a mounting cup while pressing a valve stem of the gas vessel and is integrally formed in a storage hole, which is formed on the upper surface of the vessel cap, through ribs so as to be separable, the gas exhaust unit being separated from the vessel cap by breaking the ribs when the gas exhaust unit is used, wherein the gas exhaust unit includes: a pressing part formed in the central portion of an insertion part, which protrudes toward the bottom of the mounting cup, to press the valve stem; extension ends bilaterally extending from the edge of the insertion part so as to be symmetric to each other; and coupling ends that are vertically formed on the extension ends, respectively, and are stopped by and coupled to the mounting cup to make the pressing part press the valve stem.

The coupling ends may be formed in the shape of a circular arc that has the same or a similar curvature to that of the mounting cup, and may have stoppers, respectively, which protrude from end portions of the inner surfaces thereof and are stopped by predetermined sections of the mounting cup.

Stopping protrusions may extend outward from the extension ends with respect to the pressing part such that a user's fingers are stopped by the stopping protrusions when the user separates the coupling ends from the mounting cup by lifting the extension ends upward in the state in which the coupling ends are stopped by and coupled to the mounting cup.

The stopping protrusions may have inclined surfaces formed on the distal ends thereof with which the user's fingers make contact when the user lifts the stopping protrusions upward.

A pressing end for separation may protrude from the opposite surface of each extension end on which the coupling ends are not formed, wherein the pressing end for separation is pushed toward the pressing part by the user's finger so that the corresponding coupling end is separated from the mounting cup while moving outward in cases where the coupling end is separated from the mounting cup.

The pressing end for separation may protrude from the opposite surface of the extension end so as to be spaced the same distance apart from the pressing part as the coupling end and may have the same length and curvature as the coupling end.

The gas injection adaptors may be provided on the upper surface of the vessel cap so as to be opposite to each other with respect to the gas exhaust unit.

The pressing part may have a through-hole through which the valve stem passes and an inclined pressing surface that is formed in the shape of a cone around the through-hole and presses a stopping end of the valve stem.

According to the present invention, the gas exhaust unit, which is employed for an aerosol vessel, a cigarette lighter gas vessel, or another gas vessel to easily exhaust residual gas therein, can be separated from a vessel cap only when necessary, thereby preventing a safety accident caused by unintended gas exhaust which results from operating the gas exhaust unit out of curiosity or by mistake.

Furthermore, the gas exhaust unit coupled to a mounting cup of a vessel can be easily separated from the vessel by using the stopping protrusions or the pressing ends for separation that are provided on the extension ends.

In addition, since both the coupling ends of the gas exhaust unit are coupled to a mounting cup of a gas vessel, the gas exhaust unit can continuously spray contents (gas) of the gas vessel.

These and/or other objects, features, and advantages of the invention will be apparent to those skilled in the art. The invention is not to be limited to or by these objects, features and advantages. No single embodiment need provide each and every object, feature, or advantage.

BRIEF DESCRIPTION OF THE DRAWINGS

The above and other objects, features, and advantages of the present invention will be more apparent from the following detailed description taken in conjunction with the accompanying drawings, in which.

Figure 1:
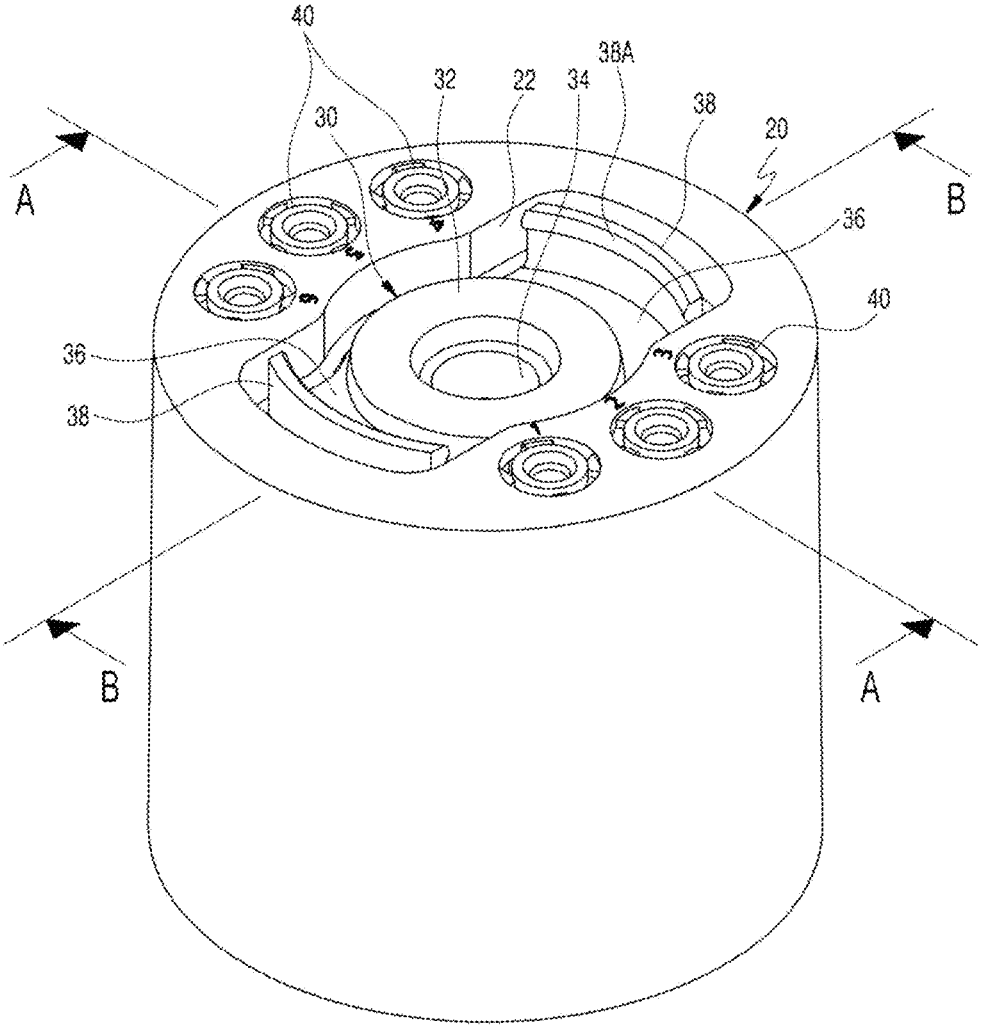
FIG. 1 is a perspective view of a cap for a gas vessel that has a separable gas exhaust unit, according to an embodiment of the present invention.

Various embodiments of the invention will be described in detail with reference to the drawings, wherein like reference numerals represent like parts throughout the several views. Reference to various embodiments does not limit the scope of the invention. Figures represented herein are not limitations to the various embodiments according to the invention and are presented for exemplary illustration of the invention.

DETAILED DESCRIPTION

Hereinafter, exemplary embodiments of the present invention will be described in detail with reference to the accompanying drawings. Meanwhile, in the following description of the present invention, detailed descriptions of well-known functions or configurations may be omitted in order to make subject matters of the present invention clear.

Figure 2:
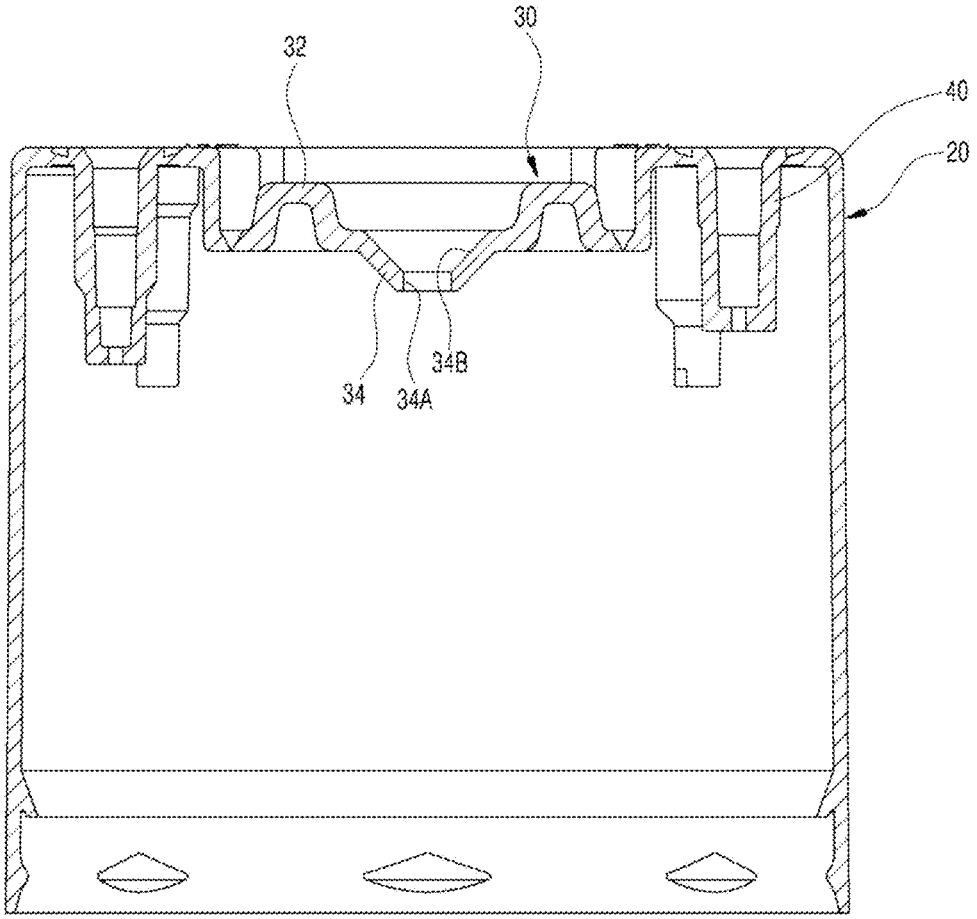
FIG. 2 is a sectional view taken along line A-A of FIG. 1.
Figure 3:
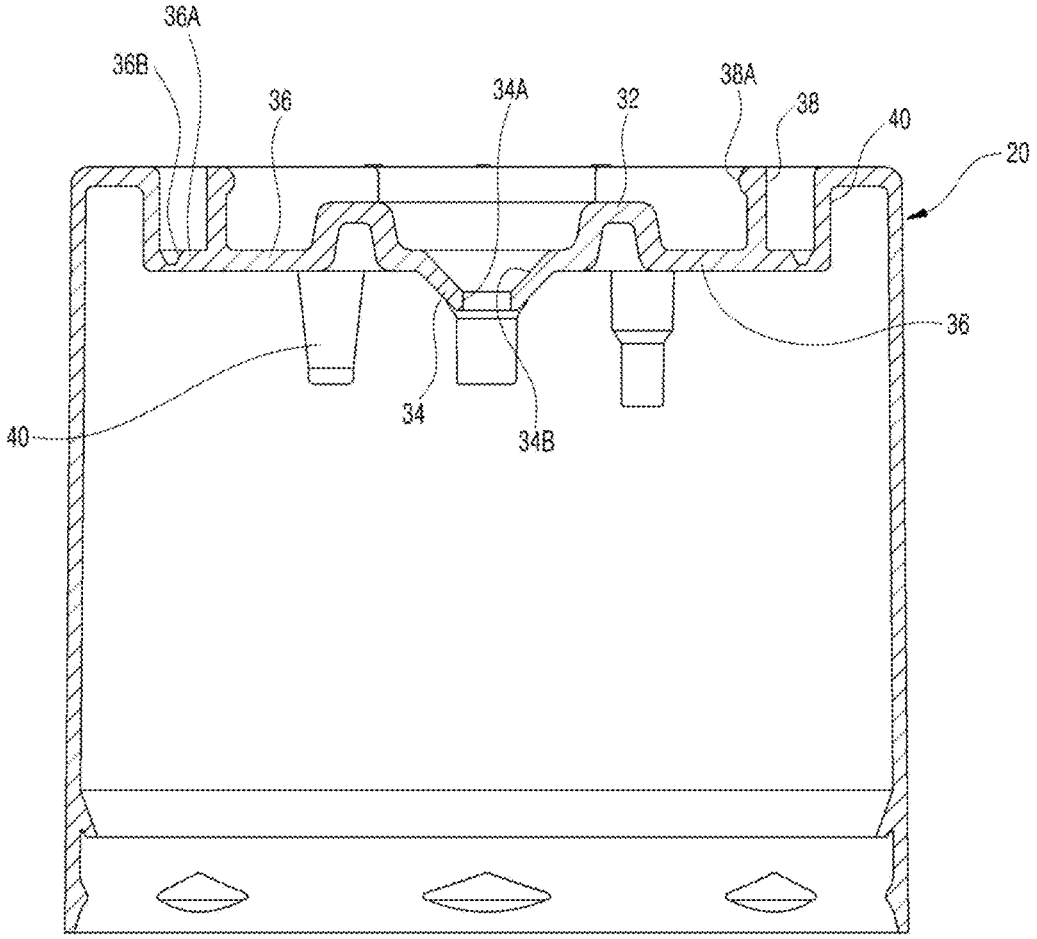
FIG. 3 is a sectional view taken along line B-B of FIG. 1.
Figure 4:
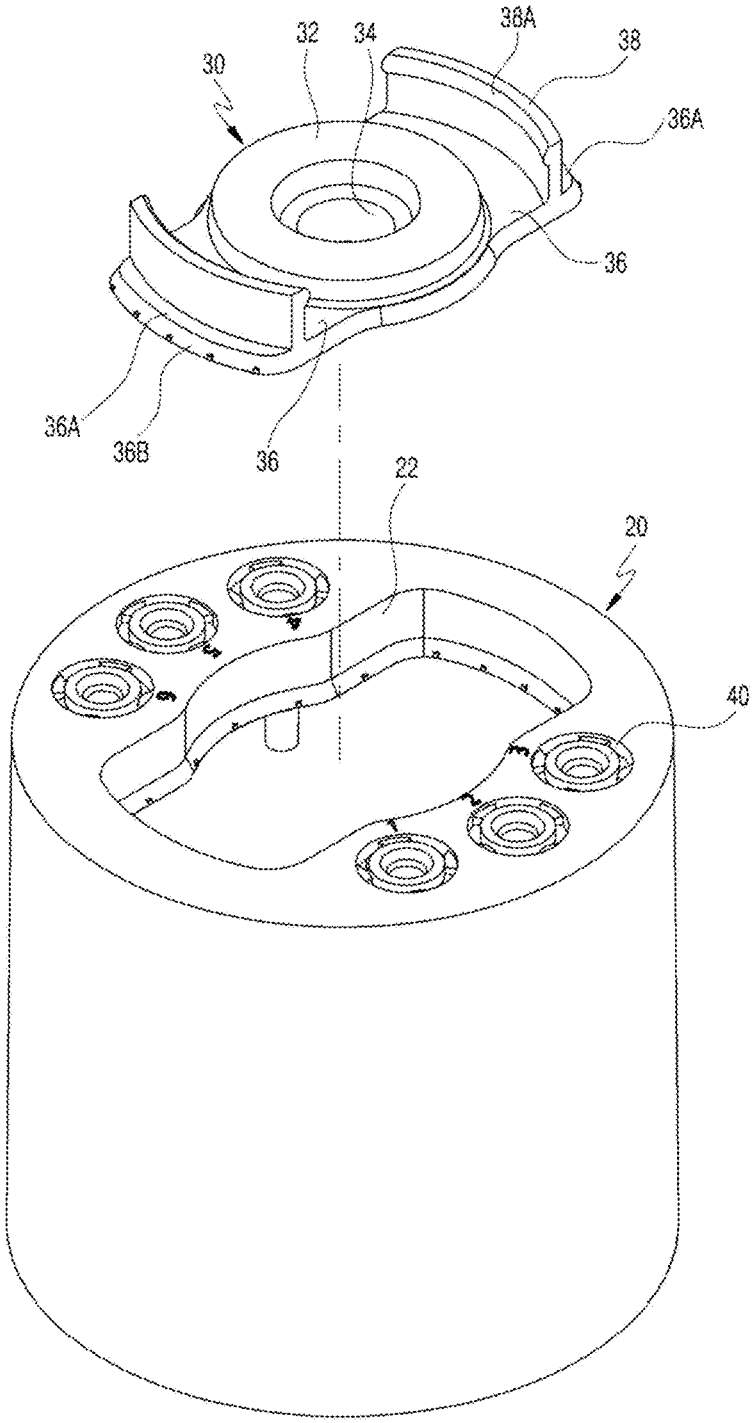
FIG. 4 is a perspective view illustrating a state in which the gas exhaust unit illustrated in FIG. 1 is separated from the vessel cap.

Among the accompanying drawings, FIG. 1 is a perspective view of a cap for a gas vessel that has a separable gas exhaust unit, according to an embodiment of the present invention, FIG. 2 is a sectional view taken along line A-A of FIG. 1, and FIG. 3 is a sectional view taken along line B-B of FIG. 1. FIG. 4 is a perspective view illustrating a state in which the gas exhaust unit illustrated in FIG. 1 is separated from the vessel cap.

As illustrated in FIGS. 1 through 4, the cap 20 for a gas vessel that has the separable gas exhaust unit, according to the present invention, is coupled to a seaming part 12 of a gas vessel 10 to protect a valve assembly 14 mounted on the upper portion of the gas vessel 10. The gas exhaust unit 30 is integrally formed in the center of the upper surface of the vessel cap so as to be separated by ribs, and a plurality of gas injection adaptors 40 that have different sizes are integrally formed in the edge area of the vessel cap so as to be separated by ribs.

Namely, the gas exhaust unit 30 and the gas injection adaptors 40 are integrally injection-molded with the vessel cap 20. However, since the gas exhaust unit 30 and the gas injection adaptors 40 are connected to the vessel cap 20 through the plurality of ribs, the gas exhaust unit 30 and the gas injection adaptors 40 may be separated from the vessel cap 20 by breaking the ribs.

Herein, the gas vessel 10 is not limited to one type of vessel and refers to a cigarette lighter gas vessel, an aerosol vessel, or another gas vessel as examples.

Further, the vessel cap 20 has a stopper that protrudes from the lower end portion of the inner surface thereof and is stopped by the seaming part 12.

The gas exhaust unit 30 is integrally injection-molded, through the ribs, in a storage hole 22 that is formed in the center of the upper surface of the vessel cap 20 which protects the valve assembly 14 of the gas vessel 10, and the gas injection adaptors 40 are integrally injection-molded, through the ribs, on the upper surface of the vessel cap 20 so as to be opposite to each other with respect to the gas exhaust unit 30.

The gas injection adaptors 40 are coupled to a valve stem 16 to inject gas into a product, such as a cigarette lighter, which requires the gas. As illustrated in FIG. 1, the plurality of gas injection adaptors 40 have different sizes and are integrally injection-molded, through the ribs, with the vessel cap 20 so as to be separated from the vessel cap 20.

Three gas injection adaptors 40 are provided on each of the opposite sides of the upper surface of the vessel cap 20 with the gas exhaust unit 30 therebetween. The aim of the arrangement structure is to prevent the gas injection adaptors 40 from interfering with extension ends 36 of the rectangular gas exhaust unit 30 that bilaterally extend from an insertion part 32 of the gas exhaust unit 30.

Although not illustrated in the drawings, the gas injection adaptors 40 may not be provided on the vessel cap 20, or may be separately manufactured and detachably mounted on the vessel cap 20 through various coupling methods.

The gas exhaust unit 30 is formed to be coupled to a mounting cup 18 while pressing the valve stem 16 of the gas vessel 10 and is integrally injection-molded through the ribs in the storage hole 22, which is formed on the upper surface of the vessel cap 20, so as to be separated from the vessel cap 20. The gas exhaust unit 30 may be separated from the vessel cap 20 by breaking the ribs when the gas exhaust unit 30 is used.

The gas exhaust unit 30 has a structure in which a pressing part 34 protrudes from the central portion of the insertion part 32 protruding toward the bottom of the mounting cup 18 and has a through-hole 34A formed therein into which the valve stem 16 is inserted, and the extension ends 36 extend from the edge of the insertion part 32 in opposite directions so as to be symmetric to each other, each of which has a coupling end 38 that is formed on one surface thereof in the vertical direction and is stopped by and coupled to the mounting cup 18 to make the pressing part 34 press the valve stem 16.

In this case, the coupling ends 38 extend in the vertical direction (in the perpendicular direction to the extension ends) and thus have self-resilience. Particularly, since the coupling ends 38 are formed in the shape of a circular arc, the resilience of the coupling ends 38 is generated in the direction in which the coupling ends 38 face each other. That is, the resilience of the coupling ends 38 is generated in the direction in which the coupling ends 38 face each other such that both of the coupling ends 38 press a stopper of the mounting cup 18 inward while surrounding the stopper.

The coupling ends 38 are formed in the shape of a circular arc that has the same or a similar curvature to that of the mounting cup 18 or in the shape of a circular arc that has the same center as the mounting cup 18 so as to be stopped by a predetermined section of the mounting cup 18, and have stoppers 38A that protrude from end portions of the inner surfaces thereof that face each other. Likewise to the coupling ends 38, the stoppers 38A are also formed in the shape of a circular arc.

Meanwhile, the gas exhaust unit 30 has stopping protrusions 36A extending from the distal end portions of the extension ends 36 such that a user's fingers are easily stopped by the stopping protrusions 36A when the user separates the gas exhaust unit 30 again in the state in which the stoppers 38A formed on the coupling ends 38 are stopped by and coupled to the mounting cup 18.

The stopping protrusions 36A further extend outward beyond the coupling ends 38 such that the user's fingers are easily stopped by the stopping protrusions 36A when the user moves his/her fingers upward in the state in which the gas exhaust unit 30 is coupled to the mounting cup 18.

Further, each of the stopping protrusions 36A may have an inclined surface 36B that is obliquely formed on one surface thereof (the surface on which the coupling end is formed) toward the distal end of the stopping protrusion 36A. The aim of the inclined surfaces 36B is to increase contact between the user's fingers and the stopping protrusions 36A so that the user's fingers are easily stopped by the stopping protrusions 36A without escaping therefrom when the user lifts the gas exhaust unit 30 by pressing the stopping protrusions 36A with his/her fingers.

The pressing part 34 has the through-hole 34A formed in the center thereof through which the valve stem 16 passes and a conically inclined pressing surface 34B which is formed around the through-hole 34A and by which a stopping end 16A formed on the intermediate portion of the valve stem 16 is stopped. That is, based on FIGS. 2 and 3, the pressing part 34 is formed in the shape of an inverted cone to have a gradually decreasing cross-section from the upper portion thereof to the through-hole 34A, and the inclined pressing surface 34B is accordingly formed on the inner surface of the pressing part 34. The inclined pressing surface 34B performs a function of guiding the valve stem 16 to the through-hole 34A and a function of pressing the stopping end 16A when the coupling ends 38 are coupled to the mounting cup 18.

Hereinafter, operations of the above-configured vessel cap, according to the embodiment of the present invention, will be described.

First, as illustrated in FIG. 4 among the accompanying drawings, in order to continuously spray the gas in the gas vessel 10 or to exhaust the residual gas in the gas vessel 10 by using the gas exhaust unit 30, the gas exhaust unit 30 is separated from the vessel cap 20 by pressing the gas exhaust unit 30 from the inside of the vessel cap 20 to break the ribs that connect the gas exhaust unit 30 and the vessel cap 20.

Since the gas exhaust unit 30 can be separated from the vessel cap 20 through the above-described process, it is possible to couple the gas exhaust unit 30 to the gas vessel 10 in order to use its function only when necessary. In other words, since the gas exhaust unit 30 is integrally formed with the vessel cap 20 through the ribs, a user has to separate the gas exhaust unit 30 from the vessel cap 20 by breaking the ribs in order to use the gas exhaust unit 30. Therefore, it is possible to avoid a safety accident of exhausting gas by mistakenly operating the gas exhaust unit 30 in an undesired situation.

Figure 5A:
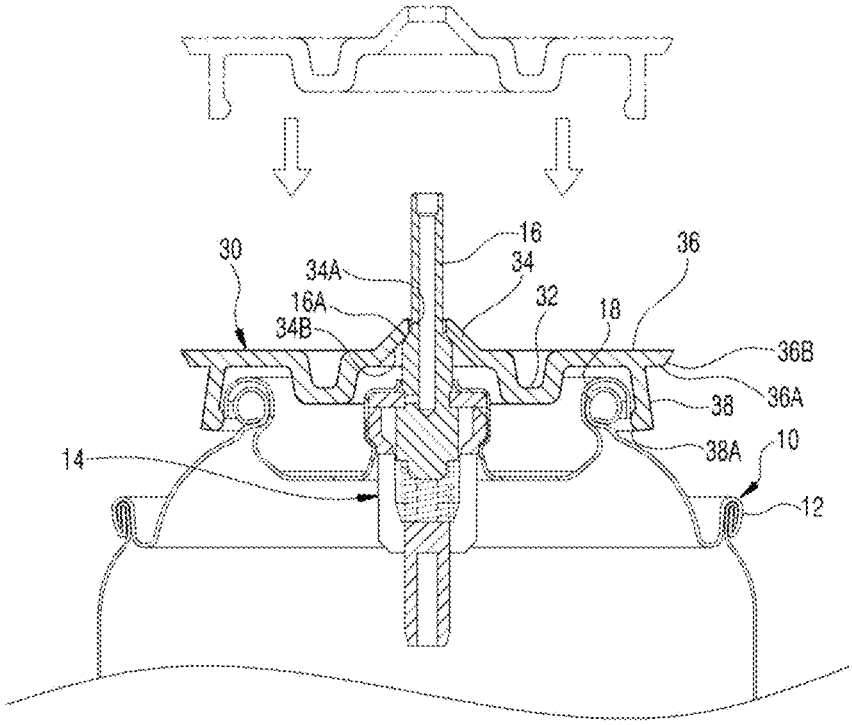
FIG. 5A/B is a view illustrating an operation of the gas exhaust unit illustrated in FIG. 1.
Figure 5B:
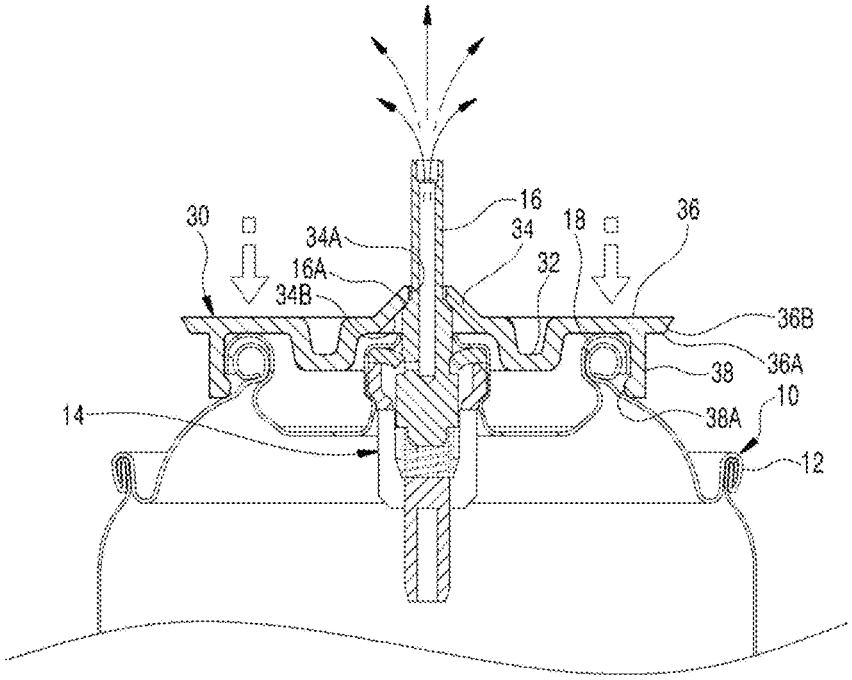

Meanwhile, when the coupling ends 38 on the opposite sides of the gas exhaust unit 30 are stopped by the mounting cup 18 according to the above-described method, the inclined pressing surface 34B of the pressing part 34 presses the stopping end 16A of the valve stem 16 as illustrated in FIG. 5. Accordingly, while the valve stem 16 is pressed, a fluid channel (a gas exhaust channel) is opened so that the gas in the gas vessel 10 is continuously sprayed, or the residual gas in the gas vessel 10 is exhausted.

Namely, the stoppers 38A of the coupling ends 38 are stopped by the mounting cup 18 at the same time that the insertion part 32 is inserted toward the bottom of the mounting cup 18, and the pressing part 34 presses the stopping end 16A formed on the intermediate portion of the valve stem 16 while the valve stem 16 passes through the through-hole 34A of the pressing part 34. The valve stem 16 is pressed through the above process to open the fluid channel so that the gas in the gas vessel 10 can be continuously sprayed, or the residual gas in the gas vessel 10 can be exhausted.

Figure 6:
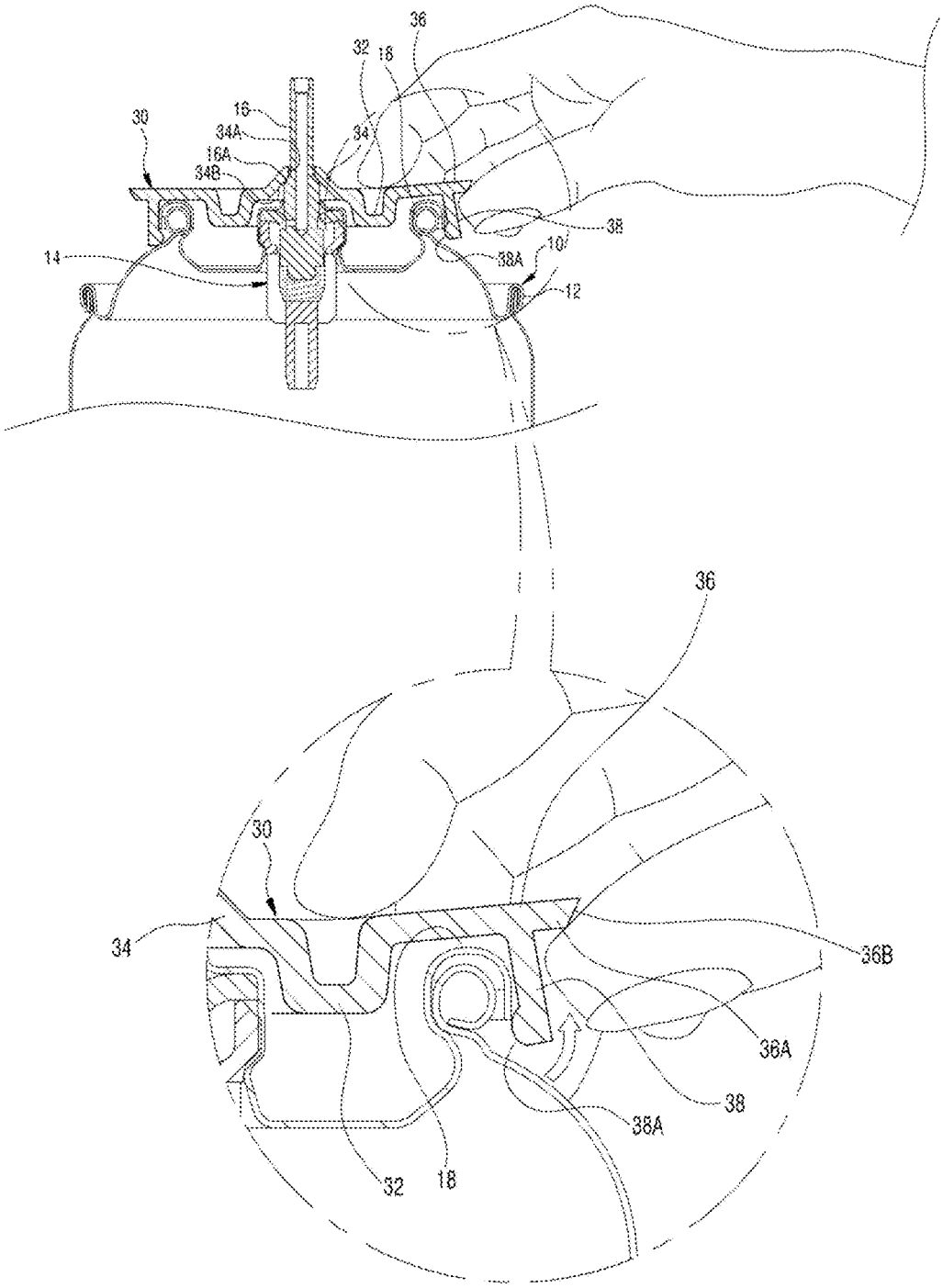
FIG. 6 is a sectional view illustrating a process of separating the gas exhaust unit illustrated in FIG. 1 from a mounting cup.

In order to separate the gas exhaust unit 30 from the gas vessel 10 in the state in which the continuous spray of the gas is completed or the residual gas is completely exhausted through the above-described process, the user brings his/her finger close to the inclined surface 36B and the stopping protrusion 36A on one side of the gas exhaust unit 30 and then lifts the stopping protrusion 36A upward as illustrated in FIG. 6 in the state in which the stoppers 38A of the coupling ends 38 are stopped by the stopper of the mounting cup 18.

The user's finger is stopped by the stopping protrusion 36A through the above-described process, and while the coupling end 38 is moved outward by the user's lifting force, the stopper 38A escapes from the stopper of the mounting cup 18 and thus is unlocked.

Since the stopper 38A of the coupling end 38 on one side of the gas exhaust unit 30 is unlocked from the mounting cup 18 as described above, the gas exhaust unit 30 can be easily separated from the gas vessel 10.

Figure 7:
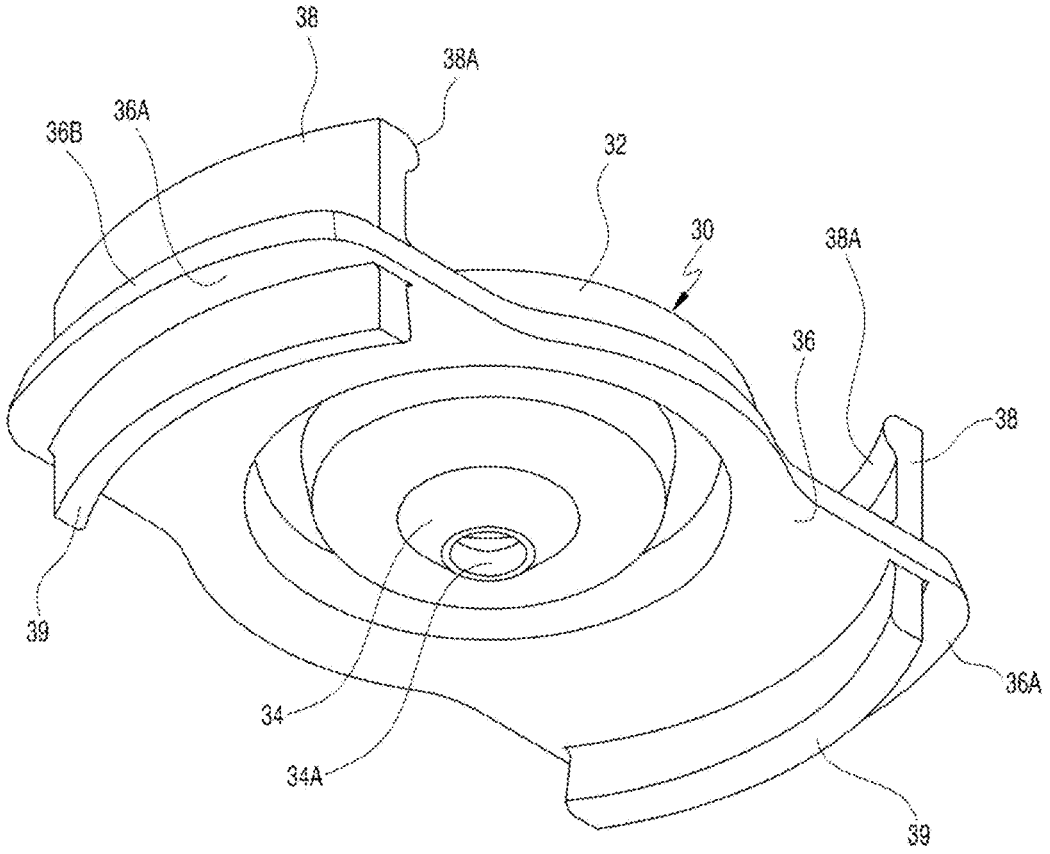
FIG. 7 is a perspective view illustrating a state in which pressing ends for separation are provided on the extension ends of the gas exhaust unit illustrated in FIG. 1.
Figure 8:
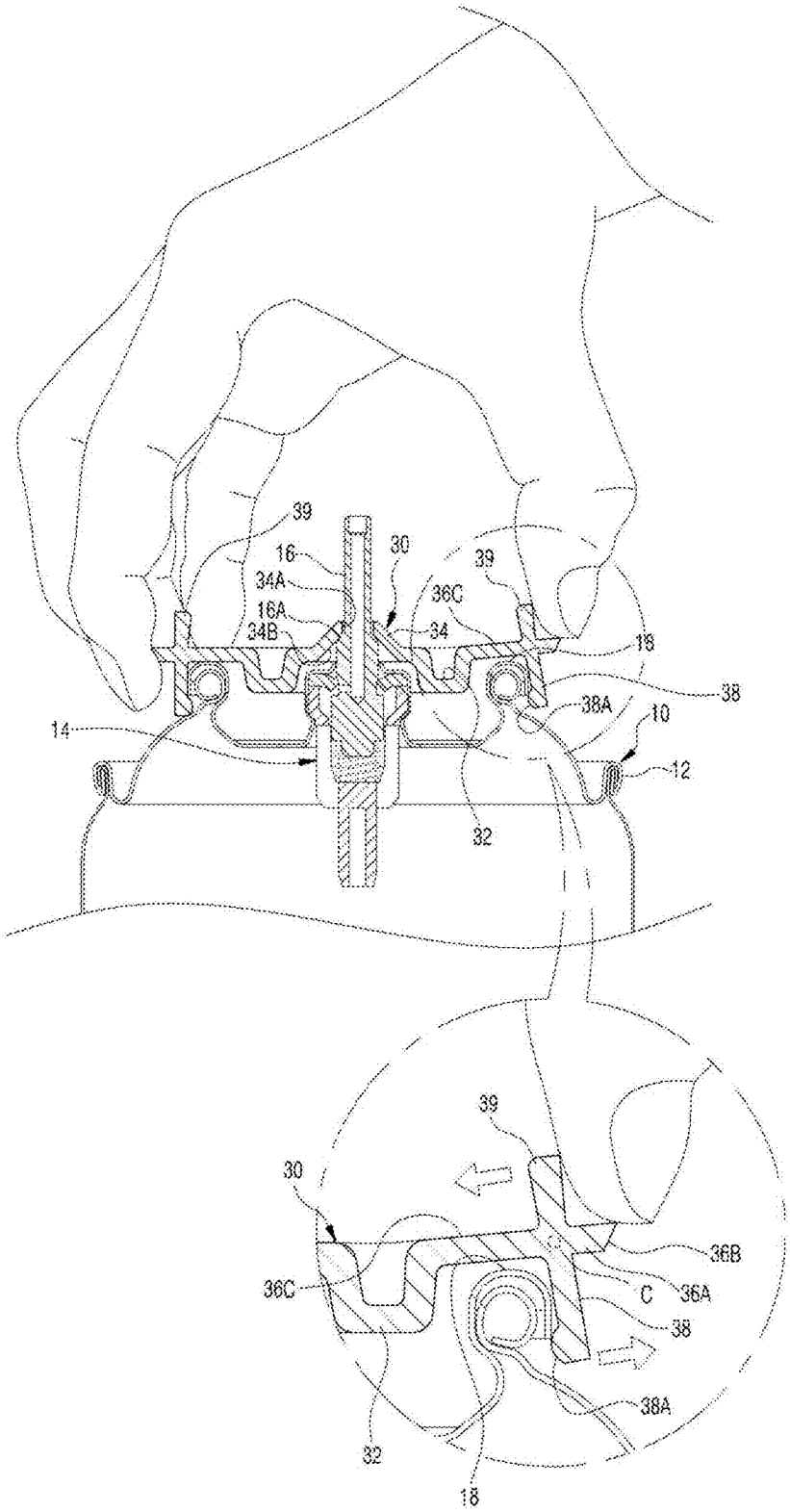
FIG. 8 is a view illustrating a process of separating the cap for a gas vessel by using the pressing ends for separation illustrated in FIG. 7.

Meanwhile, among the accompanying drawings, FIG. 7 is a perspective view illustrating a state in which pressing ends for separation are provided on the extension ends of the gas exhaust unit illustrated in FIG. 1, and FIG. 8 is a view illustrating a process of separating the cap for a gas vessel by using the pressing ends for separation illustrated in FIG. 7.

As illustrated in FIGS. 7 and 8, the pressing ends 39 for separation protrude from the surfaces 36C of the extension ends 36 on which the coupling ends 38 are not formed. In cases where the coupling ends 38 are separated from the mounting cup 18, the pressing ends 39 for separation are pushed toward the pressing part 34 by a user's finger so that the coupling ends 38 are moved outward and thus separated from the mounting cup 18.

Each of the pressing ends 39 for separation may be formed on the opposite surface 36C of the extension end 36 to be spaced the same distance apart from the pressing part 34 as the coupling end 38, and may have the same length and curvature as the coupling end 38, or may be formed to be shorter than the coupling end 38. Due to the structure, the extension end 36, the coupling end 38, the stopping protrusion 36A, and the pressing end 39 for separation form a cross-section having a "+" shape.

As described above, the pressing end 39 for separation protrudes from the opposite surface 36C of the extension end 36 so as to be spaced the same distance apart from the pressing part 34 as the coupling end 38 so that the pressing end 39 for separation and the coupling end 38 are positioned on a straight line.

Accordingly, in the case of separating the gas exhaust unit 30 from the mounting cup 18, if the pressing end 39 for separation is pushed toward the pressing part 34 as illustrated in FIG. 8, the coupling end 38 is moved outward by the principle of a lever with respect to the point C where the coupling end 38 meets the extension end 36 so that the stopper 38A can be easily unlocked from the mounting cup 18.

Although not illustrated in the drawings, the stopping protrusion 36A may be removed in cases where the pressing ends 39 for separation are provided on the extension ends 36.

As described above, according to the present invention, the gas exhaust unit 30 can be separated from the vessel cap 20 only when necessary and can be coupled to the mounting cup 18 to spray gas or exhaust residual gas, thereby preventing a safety accident, such as unintended gas exhaust caused by curiosity or mistake in cases where a gas exhaust unit is integrally formed with the vessel cap 20.

Although the specific embodiment of the present invention has been described above, it is apparent to those skilled in the art that the present invention is not limited to the embodiment disclosed herein and various modifications and changes can be made without departing from the spirit and scope of the present invention. Therefore, such modifications and changes should not be individually construed from the spirit or point of view of the present invention, and it should be understood that modified embodiments belong to the claims of the present invention.

| Description of reference numerals | |
|---|---|
| 10: Gas vessel | 12: Seaming part |
| 14: Valve assembly | 16: Valve stem |
| 16A: Stopping end | 18: Mounting cup |
| 20: Vessel cap | 22: Storage hole |
| 30: Gas exhaust unit | 32: Insertion part |
| 34: Pressing part | 34A: Through-hole |
| 34B: Inclined pressing surface | 36: Extension end |
| 36A: Stopping protrusion | 36B: Inclined surface |
| 36C: Opposite surface | 38: Coupling end |
| 38A: Stopper | |
| 39: Pressing end for separation | |
| 40: Gas injection adaptor | |

What is claimed is:

1. A cap for a gas vessel comprising:

one or more gas injection adaptors integrally provided so as to be separable from the cap;

a gas exhaust unit that is configured to be coupled to a mounting cup while pressing a valve stem of the gas vessel, the gas exhaust unit is integrally formed in a storage hole, which is formed on the upper surface of the vessel cap, through ribs so as to be separable, the gas exhaust unit being separated from the vessel cap by breaking the ribs when the gas exhaust unit is used, wherein the gas exhaust unit comprises:

a pressing part formed in the central portion of an insertion part, which protrudes toward the bottom of the mounting cup, to press a valve stem of the gas vessel;

a plurality of extension ends bilaterally extending from the edge of the insertion part so as to be symmetric to each other; and a plurality of coupling ends that protrude from the plurality of extension ends, respectively, and are stopped by and coupled to the mounting cup to make the pressing part press the valve stem of the gas vessel, wherein stopping protrusions extend outward from the extension ends with respect to the pressing part such that a user's fingers are stopped by the stopping protrusions when the user separates the coupling ends from the mounting cup by lifting the extension ends upward in the state in which the coupling ends are stopped by and coupled to the mounting cup, wherein a pressing end for separation protrudes from the opposite surface of each extension end on which the coupling ends are not formed, wherein the pressing end for separation is pushed toward the pressing part by the user's finger so that the corresponding coupling end is separated from the mounting cup while moving outward in cases where the coupling end is separated from the mounting cup.

2. The cap for a gas vessel of claim 1, wherein the coupling ends are formed in the shape of a circular arc that has the same or a similar curvature to that of the mounting cup, and have stoppers, respectively, which protrude from end portions of the inner surfaces thereof and are stopped by predetermined sections of the mounting cup.

3. The cap for a gas vessel of claim 1, wherein the pressing part has a through-hole formed in the center thereof through which the valve stem passes and an inclined pressing surface that is formed in the shape of a cone around the through-hole and presses a stopping end of the valve stem.

4. The cap for a gas vessel of claim 1, wherein the stopping protrusions have inclined surfaces formed on the distal ends thereof with which the user's fingers make contact when the user lifts the stopping protrusions upward.

5. The cap for a gas vessel of claim 1, wherein the pressing end for separation protrudes from the opposite surface of the extension end so as to be spaced the same distance apart from the pressing part as the coupling end and has the same length and curvature as the coupling end.

6. The cap for a gas vessel of claim 1, wherein the gas injection adaptors are provided on the upper surface of the vessel cap so as to be opposite to each other with respect to the gas exhaust unit.

7. A cap for a gas vessel comprising:

a gas exhaust unit that is formed to be coupled to a mounting cup while pressing a valve stem of the gas vessel and is integrally formed in a storage hole, which is formed on the upper surface of the vessel cap, through ribs so as to be separable, the gas exhaust unit being separated from the vessel cap by breaking the ribs when the gas exhaust unit is used, wherein the gas exhaust unit comprises:

a pressing part formed in the central portion of an insertion part, which protrudes toward the bottom of the mounting cup, to press a valve stem of the gas vessel;

a plurality of extension ends bilaterally extending from the edge of the insertion part so as to be symmetric to each other; and a plurality of coupling ends that protrude from the plurality of extension ends, respectively, and are stopped by and coupled to the mounting cup to make the pressing part press the valve stem of the gas vessel; and wherein the gas vessel includes one or more gas injection adaptors that are manufactured separately from the gas cap, wherein stopping protrusions extend outward from the extension ends with respect to the pressing part such that a user's fingers are stopped by the stopping protrusions when the user separates the coupling ends from the mounting cup by lifting the extension ends upward in the state in which the coupling ends are stopped by and coupled to the mounting cup, wherein a pressing end for separation protrudes from the opposite surface of each extension end on which the coupling ends are not formed, wherein the pressing end for separation is pushed toward the pressing art by the user's finger so that the corresponding coupling end is separated from the mounting cup while moving outward in cases where the coupling end is separated from the mounting cup.

8. The cap for a gas vessel of claim 7, wherein the coupling ends are formed in the shape of a circular arc that has the same or a similar curvature to that of the mounting cup, and have stoppers, respectively, which protrude from end portions of the inner surfaces thereof and are stopped by predetermined sections of the mounting cup.

9. The cap for a gas vessel of claim 7, wherein the stopping protrusions have inclined surfaces formed on the distal ends thereof with which the user's fingers make contact when the user lifts the stopping protrusions upward.

10. The cap for a gas vessel of claim 7, wherein the pressing end for separation protrudes from the opposite surface of the extension end so as to be spaced the same distance apart from the pressing part as the coupling end and has the same length and curvature as the coupling end.

11. The cap for a gas vessel of claim 7, wherein the pressing part has a through-hole formed in the center thereof through which the valve stem passes and an inclined pressing surface that is formed in the shape of a cone around the through-hole and presses a stopping end of the valve stem.

12. A cap for a gas vessel comprising:

a gas exhaust unit that is formed to be coupled to a mounting cup while pressing a valve stem of the gas vessel and is integrally formed in a storage hole, which is formed on the upper surface of the cap, through ribs so as to be separable, the gas exhaust unit being separated from the cap by breaking the ribs when the gas exhaust unit is used, wherein the gas exhaust unit comprises:

a pressing part formed in the central portion of an insertion part, which protrudes toward the bottom of the mounting cup and is configured to press a valve stem of the gas vessel;

a plurality of extension ends bilaterally extending from the edge of the insertion part so as to be symmetric to each other; and a plurality of coupling ends that protrude from the plurality of extension ends, respectively, and are stopped by and coupled to the mounting cup to make the pressing part press the valve stem of the gas vessel, wherein stopping protrusions extend outward from the extension ends with respect to the pressing part such that a user's fingers are stopped by the stopping protrusions when the user separates the coupling ends from the mounting cup by lifting the extension ends upward in the state in which the coupling ends are stopped by and coupled to the mounting cup, wherein a pressing end for separation protrudes from the opposite surface of each extension end on which the coupling ends are not formed, wherein the pressing end for separation is pushed toward the pressing part by the user's finger so that the corresponding coupling end is separated from the mounting cup while moving outward in cases where the coupling end is separated from the mounting cup.

13. The cap for a gas vessel of claim 12, wherein the coupling ends are formed in the shape of a circular arc that has the same or a similar curvature to that of the mounting cup, and have stoppers, respectively, which protrude from end portions of the inner surfaces thereof and are stopped by predetermined sections of the mounting cup.

14. The cap for a gas vessel of claim 12, wherein the pressing part has a through-hole formed in the center thereof through which the valve stem passes and an inclined pressing surface that is formed in the shape of a cone around the through-hole and presses a stopping end of the valve stem.

* * * * *